US008316771B2

(12) United States Patent
Toreheim et al.

(10) Patent No.: US 8,316,771 B2
(45) Date of Patent: Nov. 27, 2012

(54) CARTRIDGE CASE AND A ROUND COMPRISING SUCH A CARTRIDGE CASE

(75) Inventors: Jon Toreheim, Karlstad (SE); Alf Prytz, Karlskoga (SE); Geron Karlsson, Karlskoga (SE)

(73) Assignee: SAAB AB, Linköping (SE)

( * ) Notice: Subject to any disclaimer, the term of this patent is extended or adjusted under 35 U.S.C. 154(b) by 69 days.

(21) Appl. No.: 13/123,264

(22) PCT Filed: Oct. 10, 2008

(86) PCT No.: PCT/SE2008/000549
§ 371 (c)(1),
(2), (4) Date: Apr. 8, 2011

(87) PCT Pub. No.: WO2010/041987
PCT Pub. Date: Apr. 15, 2010

(65) Prior Publication Data
US 2011/0192313 A1 Aug. 11, 2011

(51) Int. Cl.
*F42B 5/26* (2006.01)

(52) U.S. Cl. ..... 102/469

(58) Field of Classification Search ..... 102/469–472, 102/377
See application file for complete search history.

(56) References Cited

U.S. PATENT DOCUMENTS

| | | | | |
|---|---|---|---|---|
| 5,421,264 | A * | 6/1995 | Petrick | 102/443 |
| 5,712,445 | A * | 1/1998 | Kassuelke et al. | 102/288 |
| 6,321,656 | B1 | 11/2001 | Johnson | |
| 6,581,522 | B1 * | 6/2003 | Julien et al. | 102/431 |
| 2004/0244358 | A1 | 12/2004 | Prytz | |
| 2006/0054046 | A1 | 3/2006 | Cook et al. | |
| 2011/0192312 | A1 * | 8/2011 | Toreheim et al. | 102/469 |

FOREIGN PATENT DOCUMENTS

FR 2686410 A1 7/1993

OTHER PUBLICATIONS

PCT/ISA/210—International Search Report—May 18, 2009.
PCT/ISA/237—Written Opinion of the International Searing Authority—May 18, 2009.

* cited by examiner

*Primary Examiner* — Michael David
(74) *Attorney, Agent, or Firm* — Venable LLP; Eric J. Franklin

(57) ABSTRACT

A cartridge case intended for explosive materials. A releasable base plate is provided in a bottom section of the cartridge case. A base plate locking device includes a temperature dependent shape memory material. The shape memory material of the base plate locking device is provided to exert a crushing force on the cartridge case at a temperature increase passing a temperature such that the shape memory material in question struggles to resume a former shape in order to break up the connection between the base plate and the bottom section of the cartridge case and release the base plate from the bottom section of the cartridge case. A round of ammunition includes the cartridge case.

10 Claims, 2 Drawing Sheets

CARTRIDGE CASE AND A ROUND COMPRISING SUCH A CARTRIDGE CASE

CROSS-REFERENCE TO RELATED APPLICATIONS

Figure 1:
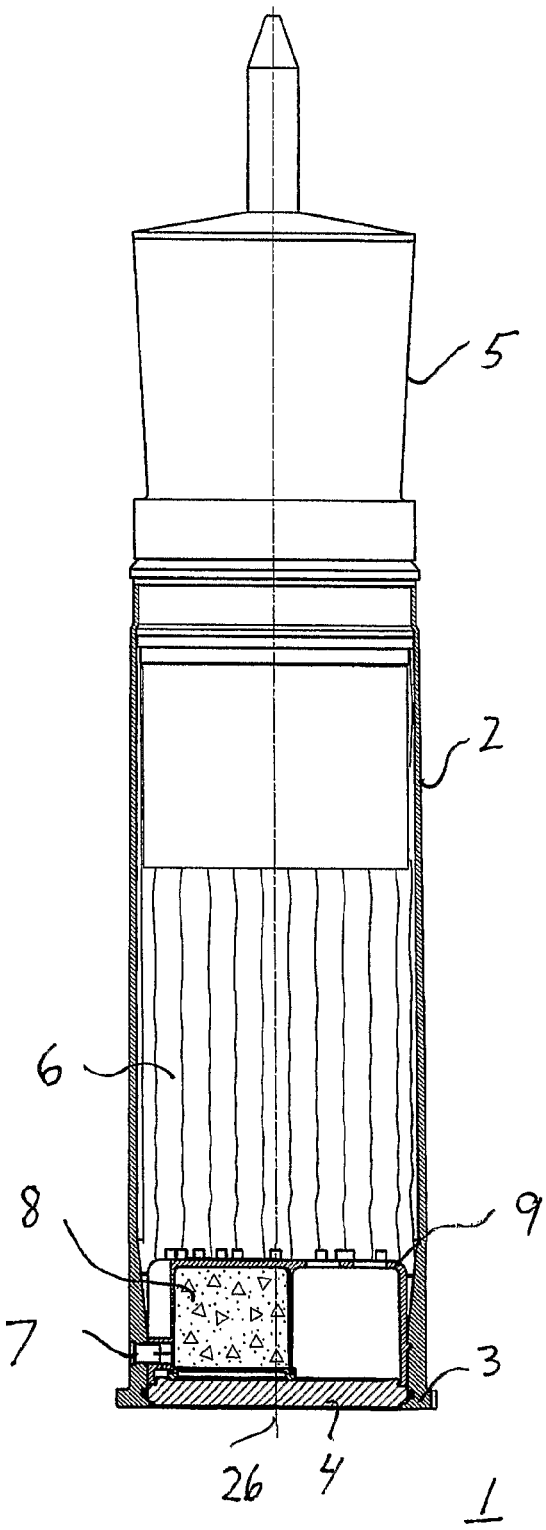

This application is the national phase under 35 U.S.C §317 of PCT/SE2008/000549 filed 10 Oct. 2008.

FIELD OF THE INVENTION

The present invention relates to a cartridge case intended for explosive materials comprising a releasable base plate provided in a bottom section of the cartridge case and a base plate locking device comprising a temperature dependent shape memory material. The invention also relates to a round of ammunition comprising such a cartridge case.

BACKGROUND OF THE INVENTION

When constructing low sensitive weapon systems, Insensitive Munitions, abbreviated IM, is an area to be considered and where to take care of the problems arising when the weapon system is subjected to heating. It is very important especially for personal safety reasons but also for transport classification reasons and for IM status reasons that a weapon system not can be brought into violent reactions when it is subjected to external stimuli.

A problem in connection to the above is that enclosed explosive materials subjected to heating will result in that the explosive materials are set to fire and burned. In this connection stronger enclosures result in more violent reactions.

An example of a cartridge case according to the first paragraph is previously known from FR 2 686 410 A1. The disclosed cartridge case comprises a shape memory material located in a space between the base plate and the bottom section. Under normal temperature conditions the shape memory material is positioned in the space to lock the base plate to the bottom section of the cartridge case. In case of a temperature increase such that the temperature exceeds a predefined critical value, the shape memory material returns to a former shape positioning the shape memory material more inwards in the space resulting in that the base plate is unblocked. The arrangement of the shape memory material suffers from some problems. One problem is that the space between the base plate and the bottom section has to be voluminous to be able to house the shape memory material both in blocked and unblocked positions. This fact inter alia renders a distinct positioning of the shape memory material in blocked and unblocked positions difficult. Furthermore, when the content of the cartridge case is subjected to heating the content is likely to expand. This results in that there is a risk that the shape memory material is secured between the base plate and the bottom section before a critical temperature for unblocking has been reached. This may result in that the base plate not is released at all or that the releasing of the base plate is unacceptably delayed.

SUMMARY OF THE INVENTION

The object of the invention is to obtain a cartridge case that is more reliable in its operation when subjected to heating and that at the same time requires minimal of adaption to cartridges on the market. The object is also to obtain a round of ammunition comprising such a cartridge case.

The object of the invention is obtain by a cartridge case characterized in that the shape memory material of the base plate locking device is provided to exert a crushing force on the cartridge case at a temperature increase passing a temperature such that the shape memory in question struggles to resume a former shape in order to break up the connection between the base plate and the bottom section of the cartridge case and release the base plate from the bottom section of the cartridge case. By means of the crushing force breaking up the connection, an opening in the cartridge case is obtained in a reliable way admitting content of the cartridge case to be released. An opening in the cartridge case is created that is great enough to relieve the over pressure arising when the explosive materials are transformed.

According to a favorable development of the cartridge case the shape memory material is provided to exert a crushing force on the base plate. Such a solution implies that the bottom section of the cartridge case surrounding the base plate can be maintained intact and a well defined opening for the created overpressure is obtained.

Advantageously, the base plate comprises indications of fractions to facilitate the breaking up of the connection between the base plate and the bottom section of the cartridge case. According to a proposed suitable embodiment the indications of fractions comprise a v-shaped recess in the periphery of the base plate. Such a shape is easy to make. When subjecting the base plate to the crushing force this example of shape of the indications of fractions contribute to a well defined crushing process of the base plate.

In particular in connection to a crushable base plate a preferred embodiment involves that the shape memory material is provided in a space between the base plate and the bottom section of the cartridge case.

Embodiments involving that the shape memory material is provided to exert a crushing force on the bottom section of the cartridge case could also be preferred. In this case the standard base plate now used needs no modification. In order to facilitate the crushing force operation of the shape memory material on the bottom section, the bottom section of the cartridge case according to an advantageous embodiment comprises indications of fractions to facilitate the breaking up of the connection between the base plate and the bottom section of the cartridge case.

When exerting a breaking force on the bottom section of the cartridge a favorable embodiment involves that the shape memory material is provided within the bottom section of the cartridge case. Preferably in that connection, the bottom section in connection to the shape memory material in a direction inwards is dimensioned to have a thinner material extension than inwards dimensions of adjacent parts of the bottom section.

The invention also refers to a round of ammunition comprising a cartridge case as defined above.

BREIF DESCRIPTION OF THE DRAWING

The invention will now be described in more detail by means of exemplified embodiments with reference to the accompanying drawings in which:

FIG. 1 in a side view and partly sectioned shows a round of ammunition that can be provided with a cartridge case according to the invention.

Figure 2A:
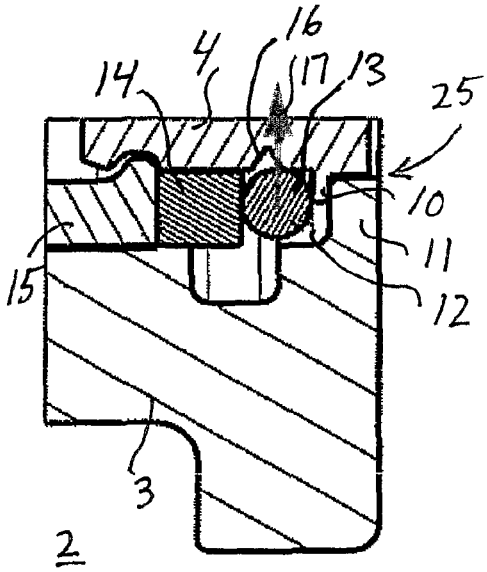
Figure 2B:
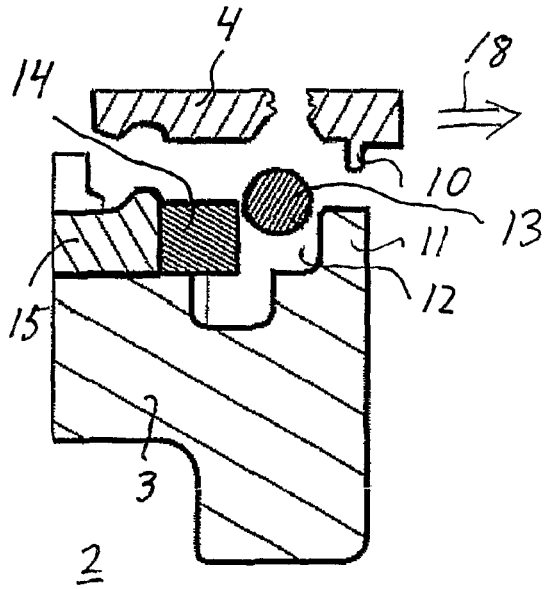

FIGS. 2*a* and 2*b* schematically in a cross section show a first example of an embodiment of a cartridge case based upon the crushing force principle before crushing and release of the base plate, FIG. 2*a*, and after crushing and release of the base plate, FIG. 2*b*.

Figure 3A:
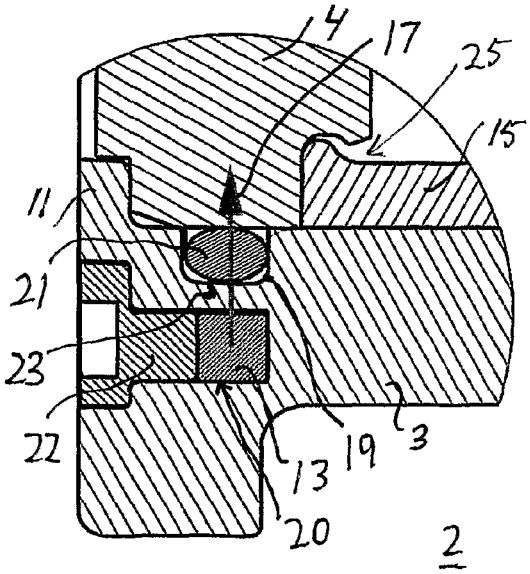
Figure 3B:
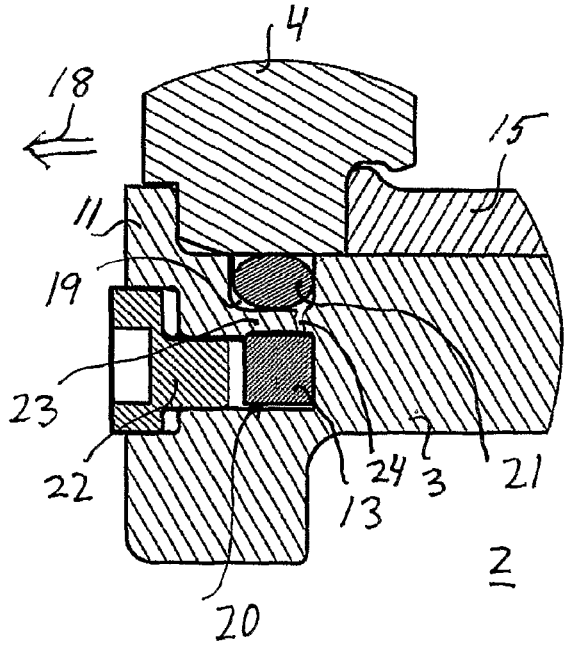

FIGS. 3*a* and 3*b* schematically in a cross section show a second example of an embodiment of a cartridge case based upon the crushing force principle before crushing and release of the base plate, FIG. 3*a*, and after crushing and release of the base plate FIG. 3*b*.

DETAILED DESCRIPTION OF EMBODIMENTS OF THE INVENTION

In FIG. 1 a round of ammunition 1 is shown suitable for base plate release arrangement according to the invention. This round comprises a cartridge case 2 with a bottom section 3 and a base plate 4. The cartridge case houses a projectile 5 driven by propellant 6 that can be in the shape of strip formed double base propellant. Furthermore there is provided a percussion cap 7, an igniter composition 8 and an igniter cap 9. The round of ammunition 1 is symmetrical and has a symmetry axis 26. The projectile comprises explosive materials of known kind and not further discussed here. The operation of the round when activated follows known common principles and will not be further described here but only the safety arrangements preventing harmful explosions when the round is subjected to undesired heating before normal use. This safety arrangement will be described below with reference to FIGS. 2*a*, 2*b*, 3*a* and 3*b*.

According to FIGS. 2*a* and 2*b* the bottom section 3 of a cartridge case 2 with a base plate 4 are shown. A base plate locking device 25 comprises an outwards projecting flange 10 located at the periphery of the base plate 4. This flange 10 cooperates with an inwards projecting flange 11 in the inner periphery of the bottom section 3 of the cartridge case 2. A space 12 is formed between the bottom section 3 and the base plate 4. This space 12 accommodates a shape memory material 13 in the shape of a ring. Suitable materials for the ring are shape memory alloys such as copper-zinc-aluminium-nickel, copper-aluminium-nickel or nickel-titanium alloys. Many other compositions are also possible. In addition to this shape memory material, the space 12 also accommodates a support ring 14 located between the ring 13 of shape memory material and an igniter cap 15. Furthermore the base plate 4 is provided with a v-shaped recess 16 around its outer periphery in close connection to the ring 13 of shape memory material.

When a round of ammunition 1 comprising a cartridge case 2 as described in the last paragraph is subjected to heating and the heating passes a resume to former shape temperature of the ring of shape memory material 13, a strong inherent force of the ring struggles to change the shape of the ring as indicated by the arrow 17 pointing radially inwards. The force from the ring is exerted on the base plate 4 at the area of the v-shaped recess 16 being an indication of fraction. The result of this force is that the base plate 4 is crushed at the area of the v-shaped recess as shown in FIG. 2*b*. An over pressure in the cartridge case can now open up the bottom of the cartridge case by pressing the base plate 4 out of its position backwards as indicated by the arrow 18. This opening up of the cartridge case has an essential effect on the conversion or transform of explosive materials contained in the cartridge resulting in an essentially less violent reaction.

A second example of a suitable embodiment to take care of explosive effects caused by undesired heating is shown in FIGS. 3*a* and 3*b*. In this case the shape memory material exerts a crushing force essentially on the bottom section 3 of the cartridge case 2. Elements that correspond to the embodiment described with reference to FIGS. 2*a* and 2*b* has been given the same reference numbers. Accordingly, there is a base plate 4 connected to the bottom section 3 of the cartridge case 2 included in a round of ammunition. The bottom section 3 is provided with an inwards projecting flange 11. In this case the base plate 4 is inserted between the projecting flange 11 of the bottom section 3 and an igniter cap 15. The base plate 4 used here needs no particular adaption so a standardized base plate already in production can be used.

The bottom section 3 is shaped with a recess 19 at the inner periphery and has a space 20 within the bottom section essentially radially outwards from the recess 19. A partition wall 23 separates the recess 19 from the space 20. The partition wall 23 is dimensioned to withstand normal forces that it can be subjected to but to break if it is subjected to a transform force of the shape memory material 13 in contact with the partition wall 23. Parameters to be considered in that connection are inter alia choice of materials, thickness, fraction indication and so on. This space contains the shape memory material 13. The recess 19 accommodates an o-ring 21 tightening the contact between the base plate 4 and the bottom plate 3. Furthermore there is a support ring 22 disposed in connection to the shape memory material.

When the round of ammunition 1 comprising the cartridge case of FIGS. 3*a* and 3*b* is subjected to heating and the heating passes a resume to former shape temperature, the shape memory material 13 exerts a force radially inwards on the partition wall 23. The force is indicated by an arrow 17. This exerted force results in that the partition wall 23 will be broken up. A fracture is indicated by reference 24 in FIG. 3*b*. In a next step the bottom section will be further broken up so that the base plate 4 under over pressure from the interior of the cartridge will leave the bottom section 3 in a direction as indicated by the arrow 18. This opening up of the cartridge case also has an essential effect on the conversion or transform of explosive materials contained in the cartridge resulting in an essentially less violent reaction.

With regard to the embodiments described above, one example refers to an embodiment where the crushing force essentially is exerted on the base plate and one example refers to an embodiment where the crushing force is exerted on the bottom section of the cartridge case. It is however easy and within the scope of the invention to modify the cartridge case and the round of ammunition. For example embodiments combining crushing of the bottom section and the base plate could be designed. It is also possible to modify the fracturing areas in many different ways without departing from the scope of the invention. It is also to be pointed out that the word crushing is to be interpreted widely from a small fracture to total smashing.

The invention claimed is:

1. A cartridge case intended for explosive materials, comprising:

a releasable base plate provided in a bottom section of the cartridge case; and a base plate locking device comprising a temperature dependent shape memory material, wherein the shape memory material of the base plate locking device is provided to exert a crushing force on the cartridge case at a temperature increase passing a temperature such that the shape memory in question struggles to resume a former shape in order to break up the connection between the base plate and the bottom section of the cartridge case and release the base plate from the bottom section of the cartridge case.

2. The cartridge case according to claim 1, wherein the shape memory material is provided to exert a crushing force on the base plate.

3. The cartridge case according to claim 2, wherein the base plate comprises indications of fractions to facilitate the breaking up of the connection between the base plate and the bottom section of the cartridge case.

4. The cartridge case according to claim 3, wherein the indications of fractions comprise a v-shaped recess in the periphery of the base plate.

5. The cartridge case according to claim 1, wherein the shape memory material is provided in a space between the base plate and the bottom section of the cartridge case.

6. The cartridge case according to claim 1, wherein the shape memory material is provided to exert a crushing force on the bottom section of the cartridge case.

7. The cartridge case according to claim 6, wherein the bottom section of the cartridge case comprises indications of fractions to facilitate the breaking up of the connection between the base plate and the bottom section of the cartridge case.

8. The cartridge case according to claim 1, wherein the shape memory material is provided within the bottom section of the cartridge case.

9. The cartridge case according to claim 8, wherein the bottom section in connection to the shape memory material in a direction inwards is dimensioned to have a thinner material extension than inwards dimensions of adjacent parts of the bottom section.

10. A round of ammunition, comprising:

a cartridge case comprising a releasable base plate provided in a bottom section of the cartridge case, and a base plate locking device comprising a temperature dependent shape memory material, wherein the shape memory material of the base plate locking device is provided to exert a crushing force on the cartridge case at a temperature increase passing a temperature such that the shape memory in question struggles to resume a former shape in order to break up the connection between the base plate and the bottom section of the cartridge case and release the base plate from the bottom section of the cartridge case.

* * * * *